US009988968B2

(12) United States Patent
Hosokawa

(10) Patent No.: US 9,988,968 B2
(45) Date of Patent: Jun. 5, 2018

(54) ENGINE COOLING SYSTEM AND METHOD FOR OPERATING THE SAME

(71) Applicant: TOYOTA JIDOSHA KABUSHIKI KAISHA, Toyota-shi, Aichi-ken (JP)

(72) Inventor: Yohei Hosokawa, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 105 days.

(21) Appl. No.: 14/883,934

(22) Filed: Oct. 15, 2015

(65) Prior Publication Data

US 2016/0177808 A1 Jun. 23, 2016

(30) Foreign Application Priority Data

Dec. 17, 2014 (JP) ..... 2014-255370

(51) Int. Cl.
*F01P 7/14* (2006.01)
*F01P 7/16* (2006.01)
*F01P 11/14* (2006.01)

(52) U.S. Cl.
CPC ..... *F01P 7/164* (2013.01); *F01P 7/162* (2013.01); *F01P 11/14* (2013.01); *F01P 2007/146* (2013.01); *F01P 2025/06* (2013.01); *F01P 2025/64* (2013.01)

(58) Field of Classification Search
CPC ..... F01P 11/14; F01P 11/18; F01P 2007/146; F01P 2025/06; F01P 7/164; F01P 2060/08; F01P 9/06
See application file for complete search history.

(56) References Cited

U.S. PATENT DOCUMENTS 4,580,531 A * 4/1986 N'Guyen ..... F01P 7/048 123/41.1
5,385,029 A * 1/1995 Yamanaka ..... B60H 1/3208 123/339.17
6,152,088 A * 11/2000 Occella ..... F01P 7/164 123/41.01

(Continued)

FOREIGN PATENT DOCUMENTS

JP 2010-180713 8/2010
JP 2011-99400 5/2011

(Continued)

*Primary Examiner* — Long T Tran
(74) *Attorney, Agent, or Firm* — Finnegan, Henderson, Farabow, Garrett & Dunner LLP

(57) ABSTRACT

An engine cooling system including a refrigerant circulation flow channel passing through an engine, an electric refrigerant pump, an electromagnetic valve arranged in the refrigerant circulation flow channel, and a control unit. In the engine cooling system, when the electric refrigerant pump is stopped and the voltage application to the electromagnetic valve is shut off when the electromagnetic valve is closed and the electric refrigerant pump is in operation, the voltage application to the electromagnetic valve is shut off when a first predetermined time period has passed after the electric refrigerant pump is stopped. When the engine is intermittently stopped during warming up of the engine, current application to the electromagnetic valve is shut off while the closed state of the electromagnetic valve is maintained.

7 Claims, 13 Drawing Sheets

(56) References Cited

U.S. PATENT DOCUMENTS

| | | | | |
|---|---|---|---|---|
| 7,237,513 | B2 * | 7/2007 | Pfeffinger | F01P 7/162 123/41.29 |
| 8,561,580 | B2 * | 10/2013 | Kakehashi | F01P 7/164 123/41.08 |
| 2006/0157002 | A1 * | 7/2006 | Pfeffinger | F01P 7/162 123/41.29 |
| 2006/0254309 | A1 * | 11/2006 | Takeuchi | F01C 11/004 62/501 |
| 2008/0314452 | A1 * | 12/2008 | Smith | G05D 11/006 137/3 |
| 2009/0173094 | A1 * | 7/2009 | Taguchi | F04B 27/1804 62/228.5 |
| 2011/0125361 | A1 * | 5/2011 | Weber | F01P 11/18 701/31.4 |
| 2011/0259287 | A1 * | 10/2011 | Kakehashi | F01P 7/164 123/41.09 |
| 2012/0137992 | A1 * | 6/2012 | Kinomuka | F01P 7/165 123/41.08 |
| 2014/0137817 | A1 * | 5/2014 | Komuro | F16K 31/0651 123/41.08 |
| 2014/0318482 | A1 * | 10/2014 | D'Epiro | F01P 7/165 123/41.1 |

FOREIGN PATENT DOCUMENTS

| | | |
|---|---|---|
| JP | 4826502 | 11/2011 |
| JP | 2014-1654 | 1/2014 |

* cited by examiner

ENGINE COOLING SYSTEM AND METHOD FOR OPERATING THE SAME

PRIORITY INFORMATION

This application claims priority to Japanese Patent Application No. 2014-255370, filed on Dec. 17, 2014, which is incorporated herein by reference in its entirety.

TECHNICAL FIELD

The present invention relates to a structure and a method for operating an engine cooling system.

BACKGROUND ART

To operate an engine efficiently, it is necessary to warm up the engine to an appropriate temperature after starting the engine. Warming up the engine has been carried out by stopping circulation of a refrigerant which cools the engine and raising the temperature of the engine. In another method, the engine is warmed up quicker by heat exchange between an exhaust gas of the engine and a refrigerant such that the refrigerant is heated using exhaust heat of the engine (e.g., see JP 4826502 B1).

Alternatively, a method has been proposed (e.g., JP 2011-99400 A), in which a valve for adjusting the flow rate of a refrigerant flowing through the engine is provided. Upon cold start of the engine, the valve is first closed to inhibit flowing of the refrigerant in the engine in order to warm up the engine, and when the temperature of the engine is raised to reach a certain level, the valve is opened to allow the refrigerant to flow through the engine while the warming up of the engine is continued. When the warming up of the engine is finished, a normal operation of causing the refrigerant to flow through a radiator to prevent overheating of the engine is carried out. It has also been proposed to use an electromagnetic valve as the valve mentioned above. A voltage is applied to such an electromagnetic valve to decrease a degree of opening of the valve, while the voltage is shut off to increase the degree of opening of the valve (e.g., see JP 2014-1654 A).

Meanwhile, a technique to intermittently stop the engine has been used in many cases as a technique to maximize fuel efficiency or minimize electric power consumption. When the engine is stopped intermittently, it is not necessary to cause the refrigerant to flow in the engine. Accordingly, it has been proposed to stop an electric refrigerant pump together with the engine to decrease the power consumption (e.g., see JP 2010-180713 A).

SUMMARY OF THE INVENTION

In the system of warming up the engine by adjusting the flow rate of a refrigerant which flows through the engine using an electromagnetic valve as recited in JP 2014-1654 A, the electric refrigerant pump may be stopped, as recited in JP 2010-180713 A, when the engine is intermittently stopped. In such a case, current application to the electromagnetic valve may be shut off to further decrease the power consumption. However, a discharging pressure of the electric refrigerant pump has not been sufficiently decreased yet immediately after the electric refrigerant pump is stopped. If the current application to the electromagnetic valve is shut off in this state, the closed state of the valve cannot be maintained and the electromagnetic valve is opened causing the refrigerant to flow through the engine. Thus, there is a problem that the warm state of the engine cannot be maintained while the engine is stopped intermittently.

An object of the present invention, therefore, is to shut off the current application to the electromagnetic valve while maintaining the closed state of the electromagnetic valve.

An engine cooling system according to an embodiment of the present invention includes a refrigerant circulation flow channel passing through the interior of an engine, a refrigerant pump configured to circulate the refrigerant through the refrigerant circulation flow channel, an electromagnetic valve arranged in the refrigerant circulation flow channel and changing a flow rate of the refrigerant passing through the engine, and a control unit configured to stop/stop the refrigerant pump and open/close the electromagnetic valve. To stop the refrigerant pump and shut off application of voltage to the electromagnetic valve when the electromagnetic valve is in the closed state and the refrigerant pump is in operation, the control, unit shuts off the voltage application to the electromagnetic valve when a first predetermined period has passed after the refrigerant pump is stopped.

The engine cooling system according to the embodiment of the present invention may include a rotational speed sensor that detects a rotational speed of the refrigerant pump. Preferably, the control unit may shut off the voltage when a second predetermined time period has passed after the actual rotational speed of the refrigerant pump detected by the rotational speed sensor becomes zero.

The engine cooling system according to the embodiment of the present invention may include a rotational speed sensor that detects a rotational speed of the refrigerant pump and a pressure sensor that detects a discharging pressure of the refrigerant pump. Preferably, the control unit may increase the first predetermined time period or the second predetermined time period in accordance with an increase of the discharging pressure or the actual rotational speed of the refrigerant pump immediately before the stop of the refrigerant pump detected by the pressure sensor or the rotational speed sensor, respectively.

In the engine cooling system according to the embodiment of the present invention, the electromagnetic valve includes a casing in which a valve seat on which a valve body is seated is formed, an electromagnetic coil mounted on the side of an inlet of the refrigerant of the valve seat in the casing, and a spring pressing the valve body toward the valve seat. Pressing force of the spring is smaller than the force exerted on the valve body by driving the pump in a direction from the inlet of the refrigerant toward the outlet of the refrigerant. When the voltage application to the electromagnetic coil is shut off while the operation of the refrigerant pump is stopped, the valve body is pressed on the valve seat by the pressing force of the spring to maintain the closed state. When the voltage application to the electromagnetic coil is shut off while the operation of the refrigerant pump is in operation, the valve body is opened so as to be detached from the valve seat by the pressure of the refrigerant from the side of the inlet of the refrigerant.

In the engine cooling system according to the embodiment of the present invention, it is preferable that the refrigerant circulation flow channel may include a first refrigerant circulation flow channel running through the interior of the engine, a second refrigerant circulation flow channel bypassing the engine, and a connecting flow channel that connects an engine outlet of the first refrigerant circulation flow channel with the second refrigerant circulation flow channel. The refrigerant pump may be configured to circulate the refrigerant through the first refrigerant circulation flow channel, the second refrigerant circulation flow channel, and the connecting flow channel. The electromagnetic valve is arranged in the connecting flow channel, and changes a flow rate of the refrigerant flowing from the first refrigerant circulation flow channel, through the engine, and to the second refrigerant circulation flow channel.

A method of operating an engine cooling system according to an embodiment of the present invention that includes a refrigerant circulation flow channel running through the interior of the engine, a refrigerant pump that circulates a flow rate of the refrigerant passing through the engine, and an electromagnetic valve arranged in the refrigerant circulation flow channel and changing the flow rate of the refrigerant passing through the engine. To stop the refrigerant pump and shut off voltage application to the electromagnetic valve while the electromagnetic valve is in a closed state and the refrigerant pump is in operation, the method of operating such an engine cooling system includes shutting off the voltage application to the electromagnetic valve when a first predetermined time period has passed after the refrigerant pump is stopped.

The present invention has an effect of shutting off the current application to the electromagnetic valve while maintaining the closed state of the electromagnetic valve when the engine is intermittently stopped during warming up of the engine.

DETAILED DESCRIPTION OF THE EMBODIMENT

<System Structure of Engine Cooling System>

Figure 1:
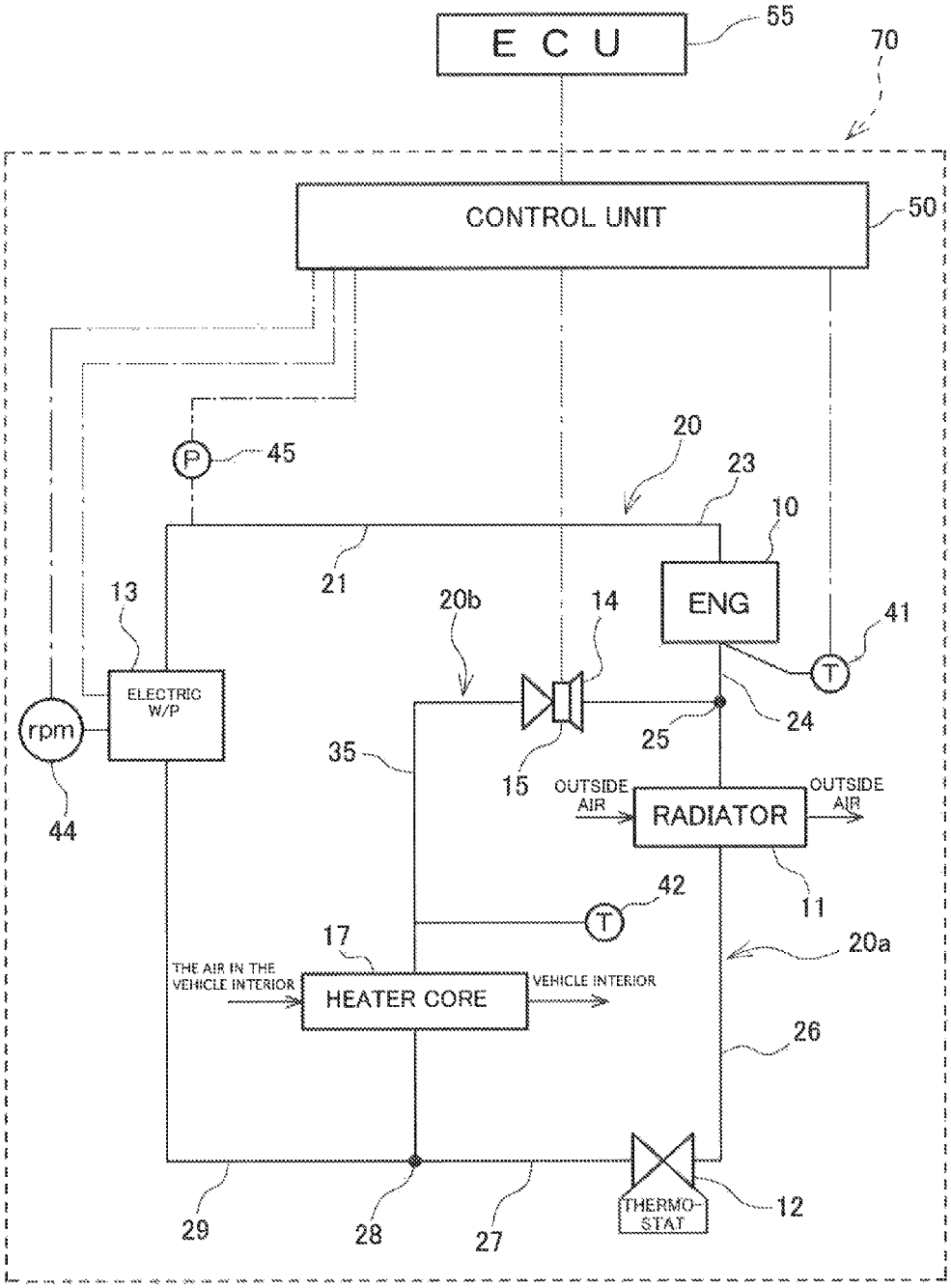
FIG. 1 is a system diagram illustrating the structure of an engine cooling system according to an embodiment of the present invention.

An engine cooling system 70 according to an embodiment of the present invention will be described below with reference to the accompanying drawings. As illustrated in FIG. 1, the engine cooling system 70 includes a refrigerant circulation flow channel passing through the interior of an engine 10, an electric refrigerant pump (EWP) 13 that circulates a refrigerant through the refrigerant circulation flow channel 20, an electromagnetic valve 14 arranged in the refrigerant circulation flow channel 20 and that changes a flow rate of the refrigerant passing through the engine 10, a heater core 17 arranged in the refrigerant circulation flow channel 20, and a control unit 50. A radiator 11 and a thermostat 12 are arranged in the refrigerant circulation flow channel 20 between an outlet of the engine 10 and the EWP 13.

As illustrated in FIG. 1, the refrigerant circulation flow channel 20 includes a pump outlet tube 21 connected to an outlet of the EWP 23, an engine inlet tube 23 that connects the pump outlet tube 21 with an inlet of the engine 10, an engine outlet tube 24 that connects the outlet of the engine 10 with the radiator 11, a radiator bypass tube 35 that branches from a branch point 25 of the engine outlet tube 24, a radiator outlet tube 26 that connects the radiator 11 with the thermostat 12, a thermostat outlet tube 27 that connects the thermostat 12 with a junction point 28 of the radiator bypass tube 35, and a pump inlet tube 29 between the junction point 28 and the electric refrigerant pump 13. The refrigerant circulation flow channel 20 includes two flow channels 20*a*, 20*b*. In the flow channel 20*a*, the refrigerant circulates through [the EWP 13, the pump outlet tube 21, the engine inlet tube 23, the engine 10, the engine outlet tube 24, the branch point 25, the radiator 11, the radiator outlet tube 26, the thermostat 12, the thermostat outlet tube 27, the junction point 28, the pump inlet tube 29, and the EWP 13]. In the flow channel 20*b*, the refrigerant passes through the radiator bypass tube 35 between the branch point 25 and the junction point to circulate through [the EWP 13, the pump outlet tube 21, the engine inlet tube 23, the engine 10, the engine outlet tube 24, the branch point 25, the radiator bypass tube 35, the electromagnetic valve 14, the heater core 17, the junction point 28, the pump inlet tube 29, and the EWP 13]. The electromagnetic valve 14 disposed in the middle of the radiator bypass tube 35 is a valve to be opened/closed by an electromagnetic coil 15 and changes the flow rate of the refrigerant flowing through the engine 10 by opening and closing operations.

A temperature sensor 41 that detects the temperature of the refrigerant in the engine 10 is disposed at a refrigerant outlet of the engine 10. Another temperature sensor 42 that also detects the temperature of the refrigerant is disposed at an inlet of the heater core 17 of the radiator bypass tube 35. A rotational speed sensor 44 is attached to the EWP 13 to detect a rotational speed of the EWP 13, while a pressure sensor 45 is attached to the pump outlet tube 21 to detect a discharging pressure of the EWP 13.

The control unit 50 is a computer that includes a central processing unit (CPU) and a storage unit. The EWP 13 and the electromagnetic coil 15 of the electromagnetic valve 14 are connected to the control unit 50 and driven by commands from the control unit 50. Detection signals of the temperature sensors 41, 42, the rotational speed sensor 44, and the pressure sensor 45 are input to the control unit 50. The control unit 50 is also configured to receive a signal from an electric control unit (ECU) 55 that controls the entire vehicle in which the engine 10 is mounted.

<Structure and Operation of Electromagnetic Valve>

Figure 2:
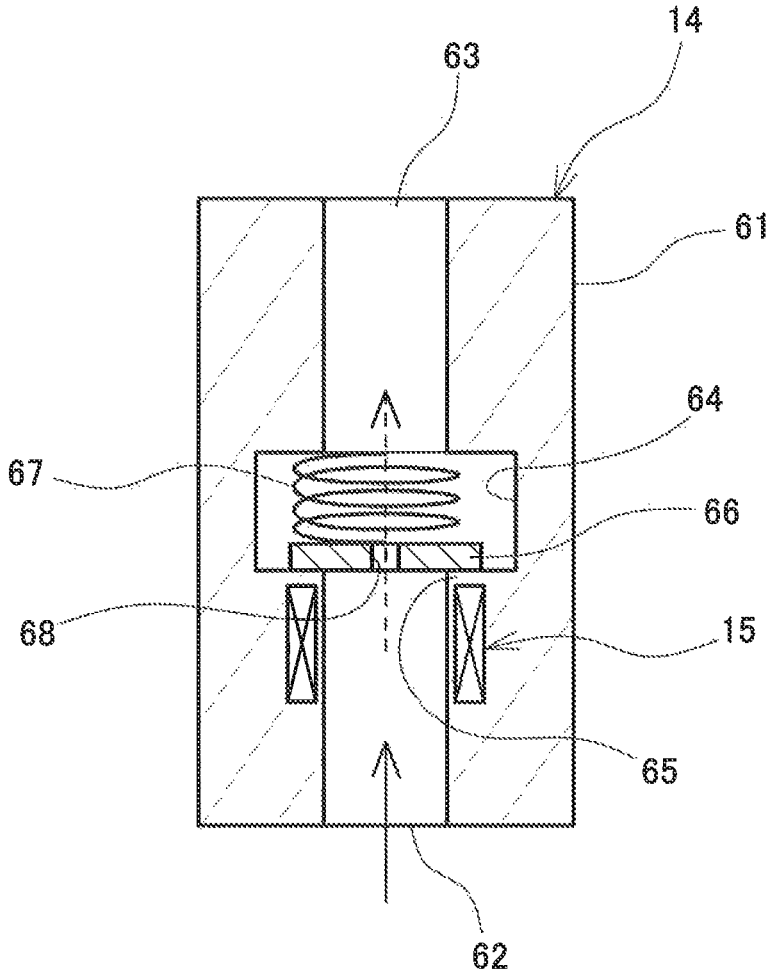
FIG. 2 is a cross-sectional view of a closed state of an electromagnetic valve used in the engine cooling system according to the embodiment of the present invention.

As illustrated in FIG. 2, the electromagnetic valve 14 includes a refrigerant inlet 62, a refrigerant outlet 63, a casing 61 in which a cavity 64 is formed, the cavity accommodating a coil spring 67 and a valve body 66 arranged between the refrigerant inlet 62 and the refrigerant outlet 63, a valve seat 65 formed on the side of the refrigerant inlet 62 of the cavity 64, and an electromagnetic coil 15 arranged on the side of the refrigerant inlet 62 of the valve seat 65. The coil spring 67 presses the valve body 66 toward the valve seat 65. However, pressing force of the coil spring 67 to press the valve body 66 to the valve seat 65 is smaller than the force generated by a pressure of the refrigerant caused by the operation of the EWP 13 from the refrigerant inlet 62 to the refrigerant outlet 63. When a voltage is applied, the electromagnetic coil 15 sucks the valve body 66 toward the side of the refrigerant inlet 62. The maximum suction force is applied to the valve body 66 by the electromagnetic coil 15 when the valve body 66 is seated on the valve seat 65. The suction force decreases as the valve body 66 is detached from the valve seat 65. A very small hole 68 is formed in the center of the valve body 66 to penetrate through the valve body 66 to communicate with the refrigerant inlet 62 and the refrigerant outlet 63.

Figure 3:
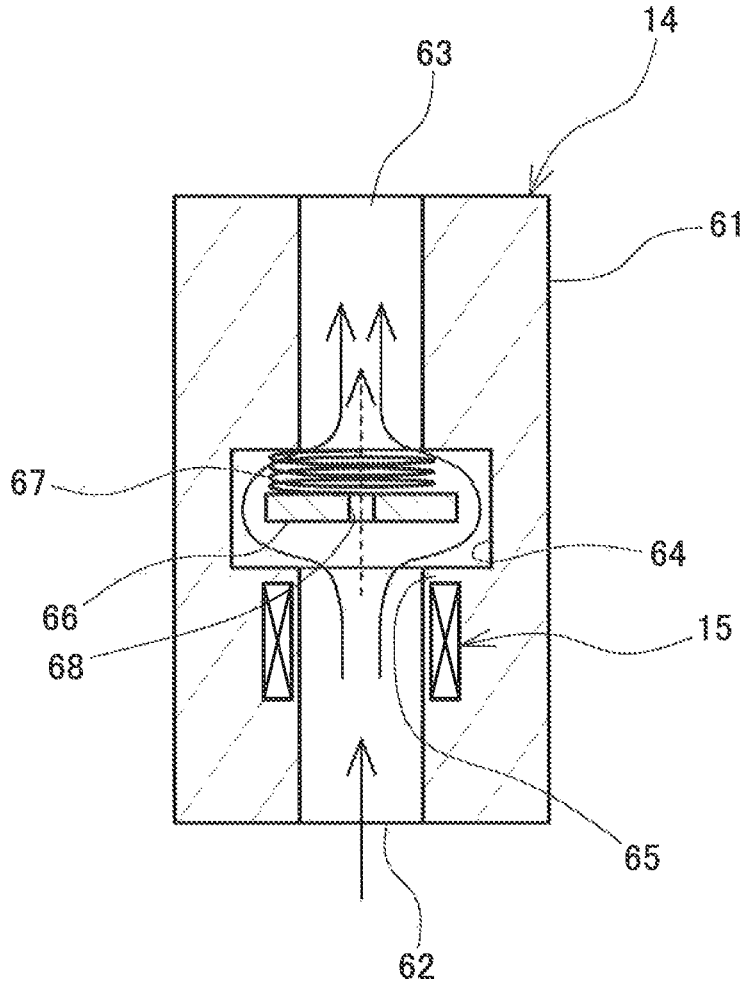
FIG. 3 is a cross-sectional view of an open state of the electromagnetic valve used in the engine cooling system according to the embodiment of the present invention.

The electromagnetic valve 14 is operated to open/close the valve in accordance with an operation state of the EWP 13 and a voltage application state to the electromagnetic valve 14. When the EWP 13 is stopped, the valve body 66 is seated on the valve seat 65 by the pressing force of the coil spring 67 regardless of the voltage application to the electromagnetic coil 15. As described above, the pressing force of the coil spring 67 to press the valve body 66 on the valve seat 65 is smaller than the force generated by the pressure of the refrigerant caused by the operation of the EWP from the refrigerant inlet 62 to the refrigerant outlet 63. If, therefore, the EWP 13 is driven while no voltage is applied to the electromagnetic coil 15, the valve body 66 is detached from the valve seat 65 by the pressure of the refrigerant and the refrigerant flows from the refrigerant inlet 62 toward the refrigerant outlet 63, as illustrated in FIG. 3. If the voltage is applied to the electromagnetic coil 15, the valve body 66 is pressed on the valve seat 65 by the pressing force of the coil spring 67 and the suction force caused by the electromagnetic coil 15, as illustrated in FIG. 2. A combination of the pressing force and the suction force is larger than the force acting on the valve body 66 in a direction toward the refrigerant outlet 63 due to the pressure of the refrigerant applied to the refrigerant inlet 2 when the EWP is driven. If, therefore, the EWP 13 is driven while the voltage is applied to the electromagnetic coil 15, the valve body 66 can be kept seated, that is, the closed state of the valve is maintained. Meanwhile, as illustrated in FIG. 3, the suction force caused by the electromagnetic coil 15 to suck the valve body 66 becomes weaker as the valve body 66 is detached from the valve seat 65 by the pressure of the refrigerant. When the valve body 66 is moved to the upper side of the cavity 64 by the pressure of the refrigerant, as illustrated in FIG. 3, the suction force caused by the electromagnetic coil 15 becomes smaller than the force applied to the valve body 66 by the pressure of the refrigerant. Thus, once the electromagnetic valve 14 is opened and moved to the upper side of the cavity 64, it would not be possible to suck the valve body 66 to place it on the valve seat 65 even if the voltage is applied to the electromagnetic coil 15. In this case, the operation of the EWP 13 is stopped to remove the pressure of the refrigerant, the valve body 66 is moved toward the valve seat 65 by the force of the coil spring 67, and then the valve body 66 is seated on the valve seat 65 by the sucking force of the electromagnetic coil 15. As described above, when the valve body 66 is seated on the valve seat 65, such a seated state can be maintained so long as the voltage is applied to the electromagnetic coil 15 even when the EWP 13 is driven. The electromagnetic valve 14 can be closed by temporarily stopping the EWP 13 while the electromagnetic valve 14 is open and then applying the voltage to the electromagnetic valve 14. That is, the electromagnetic valve 14 is opened and closed by applying and shutting off the voltage to the electromagnetic coil 15. When the EWP 13 is driven while the voltage is shut off, the electromagnetic valve 14 is opened by the increase in the pressure of the refrigerant. When the EWP is stopped and the voltage is applied to the electromagnetic coil 15, the electromagnetic valve 14 is closed. The electromagnetic valve 14 also maintains the closed state even when the voltage is shut off while the EWP 13 is stopped, and is opened when the voltage is shut off while the EWP 13 is in operation. The electromagnetic valve 14 is configured to allow a small quantity of refrigerant to flow through the very small hole 68 formed in the valve body 66 even when the electromagnetic valve 14 is in the closed state. When the pressure on the side of the refrigerant outlet 63 is higher than the pressure on the side of the refrigerant inlet 62 illustrated in FIG. 2, the valve body 66 is pressed on the valve seat 65 by a fluid pressure and substantially prevents the refrigerant from flowing from the side of the refrigerant outlet 63 to the side of the refrigerant inlet 62. Thus, the electromagnetic valve 14 is configured as an electromagnetic check valve or a check valve with an electromagnetic closed state maintaining function.

<Operation of the Engine Cooling System and a Flow of Refrigerant During Cold Start of the Engine>

An operation and a refrigerant flow during the cold start of the engine in the engine cooling system 70 described above including the electromagnetic valve 14 will be described below. In the initial state, both the EWP 13 and the engine 10 are stopped, while the electromagnetic valve 14 is closed and the refrigerant flow is stopped. The thermostat 12 is also in a closed state because of a low temperature of the engine 10.

Figure 4:
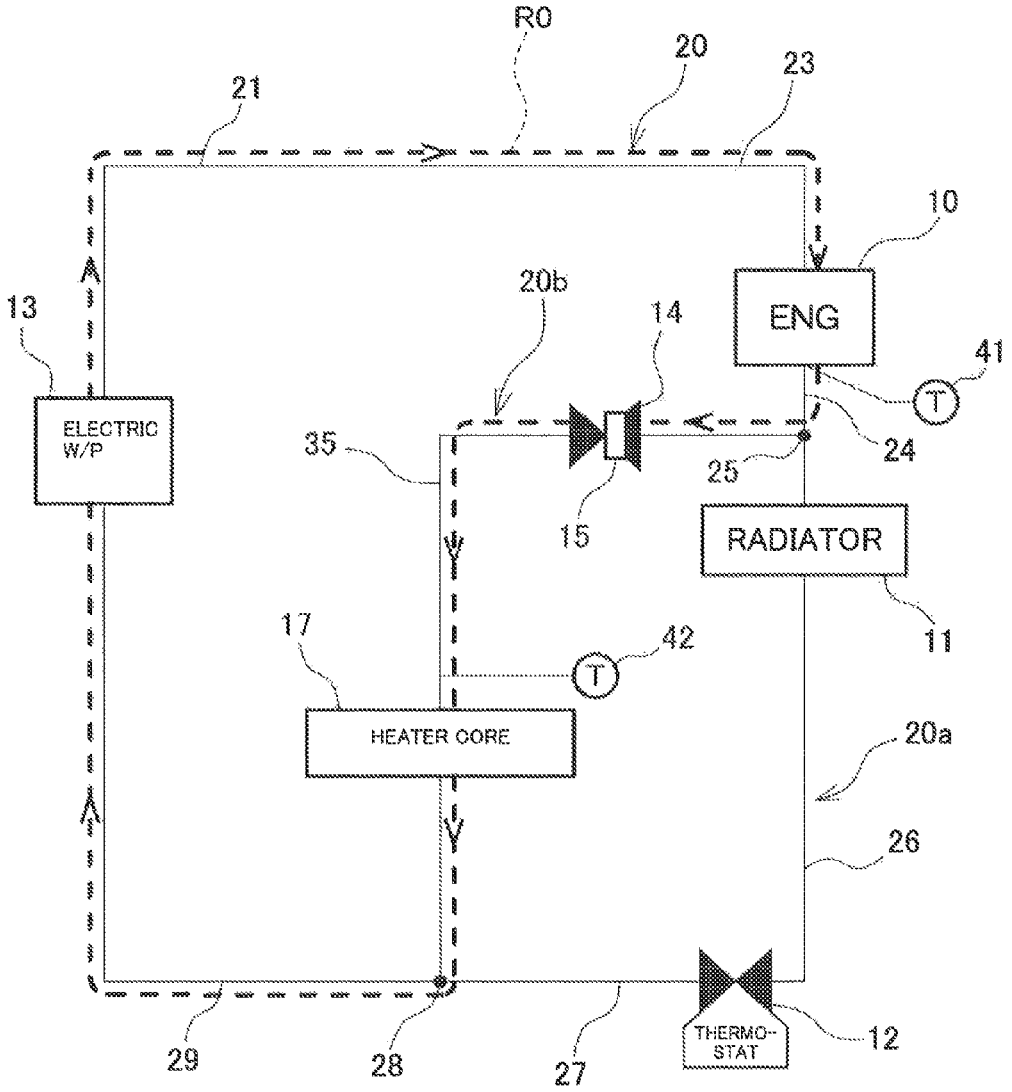
FIG. 4 is an explanatory view illustrating a refrigerant flow immediately after cold start of the engine in the engine cooling system according to the embodiment of the present invention.

When a signal representing that the engine 10 has been started is input to the control unit 50 from the ECU 5, the control unit 50 switches a command to apply a voltage (voltage apply command) to the electromagnetic coil 15 of the electromagnetic valve 14 to an on state. In accordance with this command, the voltage is applied to the electromagnetic coil 15 of the electromagnetic valve 14, causing the valve body 66 of the electromagnetic valve 14 to be sucked to the valve seat 65 by the electromagnetic force of the electromagnetic coil 15, as illustrated in FIG. 2. Subsequently, the control unit 50 outputs a command to start the EWP 13. In accordance with this command, the EWP 13 is started. Since the voltage has already been applied to the electromagnetic coil 15 of the electromagnetic valve 14, the valve body 66 is sucked to the valve seat 65 and kept in the seated state even when EWP is started and the pressure of the refrigerant is applied. In this state, the electromagnetic valve 14 is in the closed state, as illustrated in FIG. 4, and the refrigerant is discharged from the EWP 13 to pass through the very small hole 68 of the valve body 66 of the electromagnetic valve 14 to circulate through the flow channel 20*b* running through the EWP 13, the pump outlet tube 21, the engine inlet tube 23, the engine 10, the radiator bypass tube 35, the heater core 17, the junction point 28, the pump inlet tube 29, and the EWP 13 (the refrigerant circulation flow channel is indicated by a broken line arrow R0 in FIG. 4). The flow rate of the circulating refrigerant is limited by the very small hole 68 of the valve body 66. The flow rate is sufficiently small to barely maintain evenness of the temperature distribution of the refrigerant in the interior (e.g., a water jacket) of the engine 10 and not large enough to be used for cooling the engine 10. As a result, the temperature of the refrigerant in the interior of the engine 10 (e.g., the water jacket) is gradually increased as the heat is generated by the combustion of the engine 10.

Figure 5:
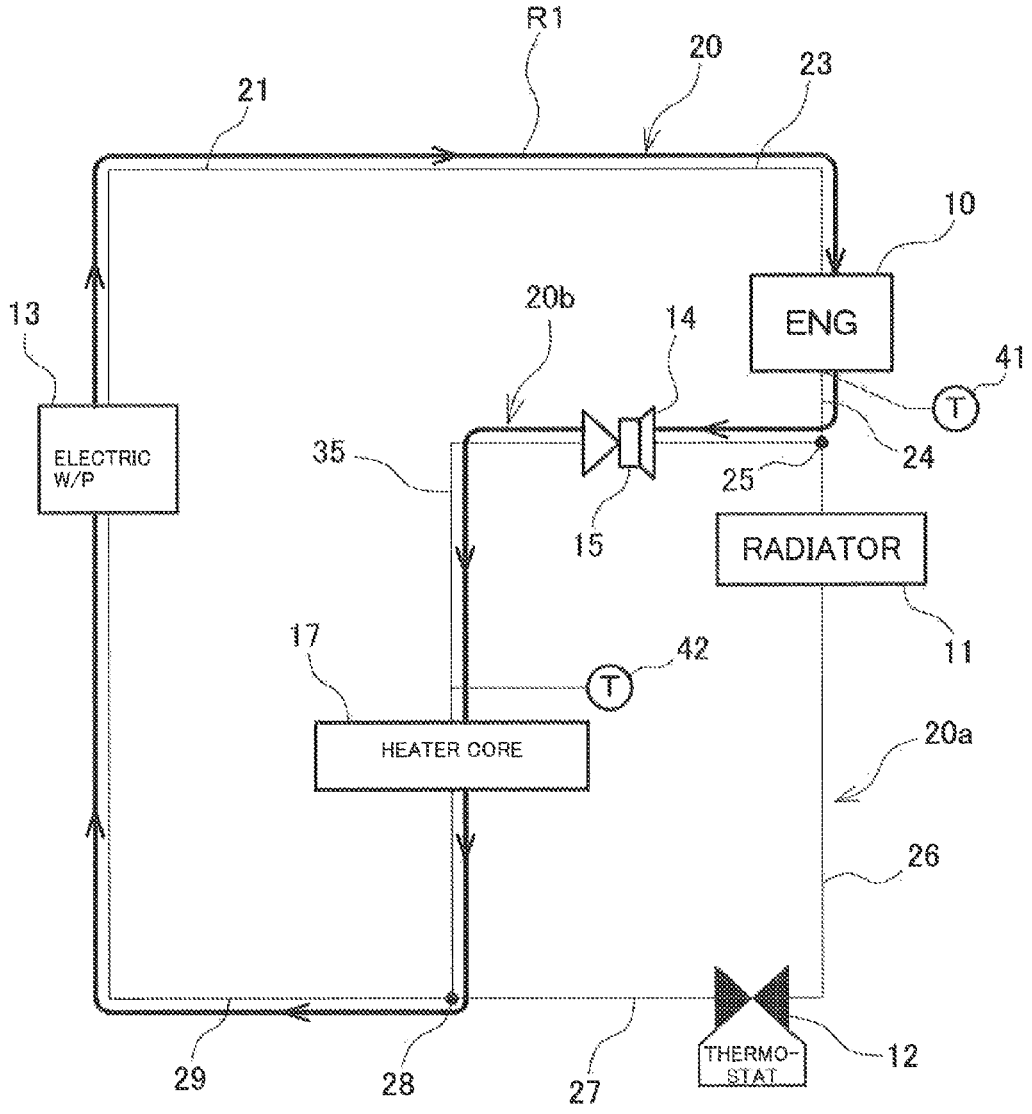
FIG. 5 is an explanatory view illustrating a refrigerant flow during warming up of the engine in the engine cooling system according to the embodiment of the present invention.

When the temperature of the refrigerant at the engine outlet detected by the temperature sensor 41 is raised to a predetermined temperature such as about 60° C., the control unit 50 outputs a command to shut off the voltage application (i.e., turn off the voltage apply command) to the electromagnetic coil 15 in order to open the electromagnetic valve 14 to allow more refrigerant to flow to the engine 10. In accordance with this command, the voltage to the electromagnetic coil 15 is shut off. Since the EWP 13 is in operation, the pressure of the refrigerant is applied to the refrigerant inlet 62 of the electromagnetic valve 14, as illustrated in FIG. 3. Upon shutting off of the voltage to the electromagnetic coil 15, the valve body 66 is detached from the valve seat 65 and moves to the upper side of the cavity 64, to thereby open the electromagnetic valve 14. Opening of the electromagnetic valve 14 accompanies an increase in the flow rate of the refrigerant that flows through the flow channel 20*b* described above. In FIG. 5, the flow rate of the refrigerant has been increased compared to the state illustrated in FIG. 4, and the circulating flow channel of the refrigerant is indicated by a solid line arrow R1. At this point, the refrigerant does not pass through the radiator 11 and thermostat 12, because the temperature of the engine 10 is lower than the temperature at which the thermostat 12 is opened.

Figure 6:
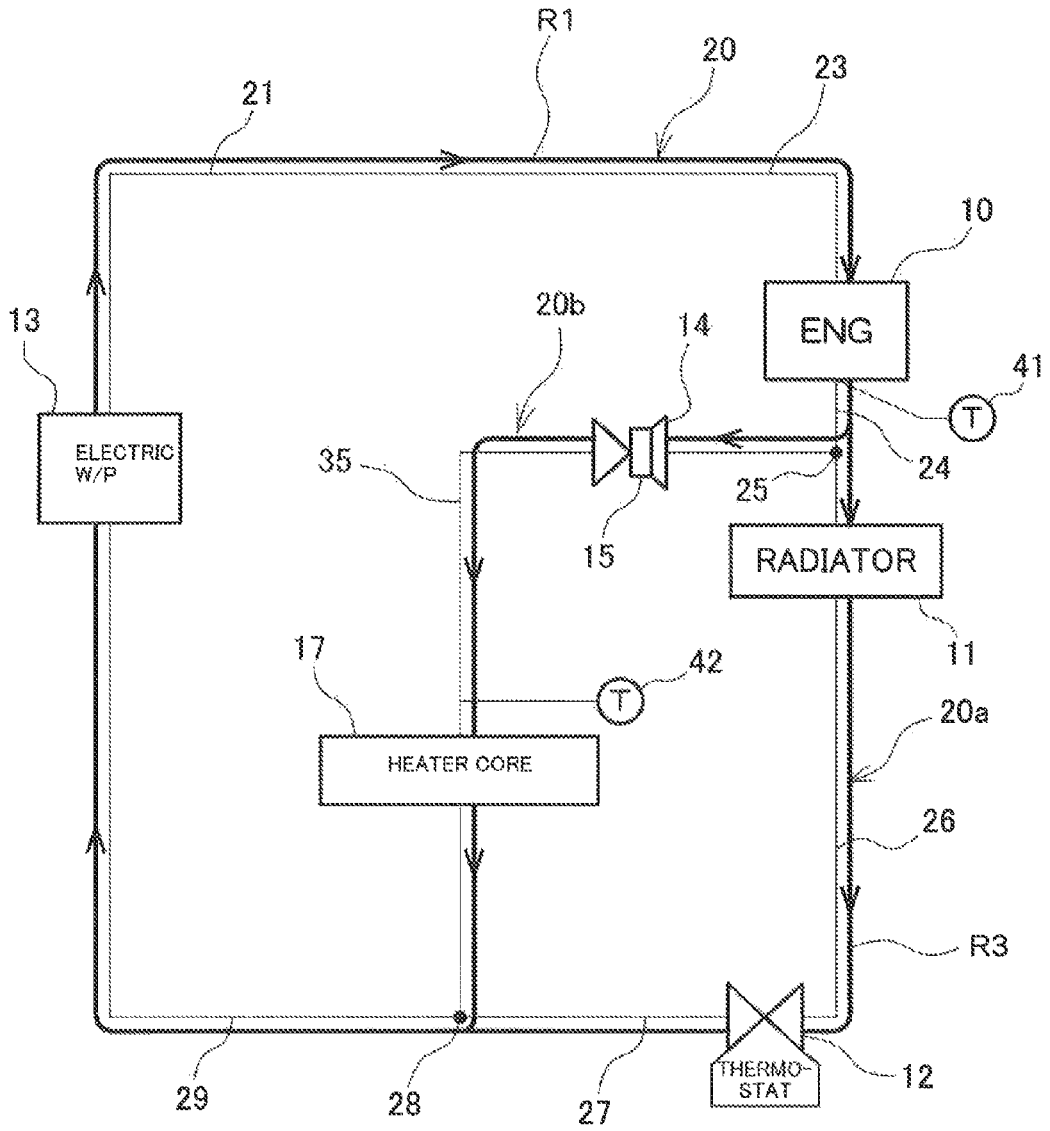
FIG. 6 is an explanatory view illustrating a refrigerant flow after the warming up of the engine (during normal operation) in the engine cooling system according to the embodiment of the present invention.

In this state, the temperature of the refrigerant flowing through the flow channel 20*b* has been raised to about 50 to 60° C. When heating of the interior of the vehicle is requested, the air in the interior of the vehicle flows in the heater core 17 and the heated air is blown to the interior of the vehicle from a blower. As the engine 10 is run for a while in this state, the temperature of the engine 10 is gradually increased, and the temperature of the refrigerant is also increased. When the temperature of the refrigerant at the outlet of the engine 10 is raised to a temperature such as about 80° C., the thermostat 12 is opened and the refrigerant starts to flow through the flow channel 20*a* from the outlet of the engine 10 to the radiator 11, the junction point 28, and the EWP 13. The refrigerant flow is indicated by a solid line arrow R3 in FIG. 6. The refrigerant flows through the flow channels 20*a*, 20*b* and normal operation ensues. The temperature of the refrigerant raised by passing through the engine 10 is reduced by the radiator 11.

<Operation of the Engine Cooling System when the Engine is Stopped Intermittently During Warming Up after Cold Start of the Engine>

Figure 7:
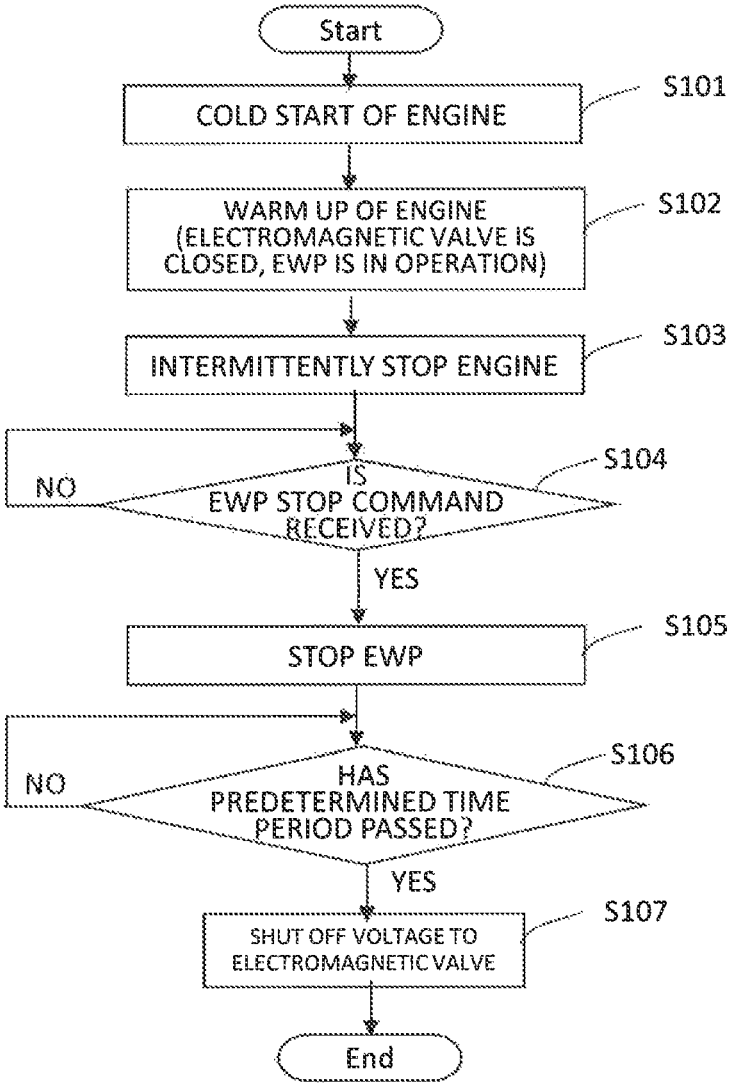
FIG. 7 is a flowchart illustrating an operation of stopping an electric refrigerant pump (EWP) and shutting off voltage application to the electromagnetic valve when the engine is intermittently stopped in the engine cooling system according to the embodiment of the present invention.

An operation of the engine cooling system 70 when the engine is stopped intermittently during the warming up operation after the cold start of the engine 10 will be described with reference to FIGS. 7 to 8D. The cold start of the engine 10 is indicated by time t1 in FIGS. 8A to 8D. As illustrated in step S101 of FIG. 7, when the engine 10 is started in the cold state, a signal representing the cold start of the engine 10 is input from the ECU 55 to the control unit 50. As illustrated in step S102, when the signal representing the cold start of the engine 10 is input, the control unit 50 switches a drive command of the EWP 13 from an off state to an on state, as indicated by a solid line a of FIG. 8A, at time t1 illustrated in FIGS. 8A to 8D, while switching a voltage apply command of the electromagnetic valve 14 from an off state (shutting off the voltage) to an on state (applying the voltage), as indicated by a solid c in FIG. 8C. Accordingly, the EWP 13 starts operation at time t1 illustrated in FIGS. 8A to 8D to increase the rotational speed and the discharging pressure after time t1, as indicated by a solid line b in FIG. 8B. Since the voltage is applied to the electromagnetic coil 15 of the electromagnetic valve 14 at time t1, the electromagnetic valve 14 is kept in the closed state even when the EWP 13 starts operation. Accordingly, as indicated by a solid line d of FIG. 8D, a lift of the electromagnetic valve 14 is kept to zero and the flow rate in the electromagnetic valve 14 is also kept to approximately zero. As described by reference to FIG. 4, since the thermostat 12 is also closed immediately after the cold start of the engine 10, the refrigerant circulates after time t1 illustrated in FIGS. 8A to 80 through the flow channel 20*b* indicated by the broken line R0 arrow in FIG. 4, to allow a very small quantity of refrigerant to flow through the interior of the engine 10. The temperature of the engine 10 is raised by combustion of the fuel, similar to the operation of the engine 10 immediately after the cold start of the engine as described above by reference to FIG. 4.

Figure 8A:
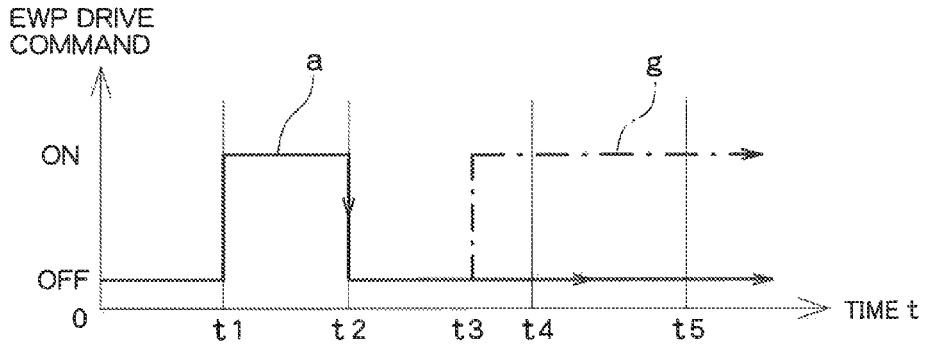
FIG. 8A is a graph illustrating the change of a drive command of the EWP over time when the engine is intermittently stopped in the engine cooling system according to the embodiment of the present invention.
Figure 8B:
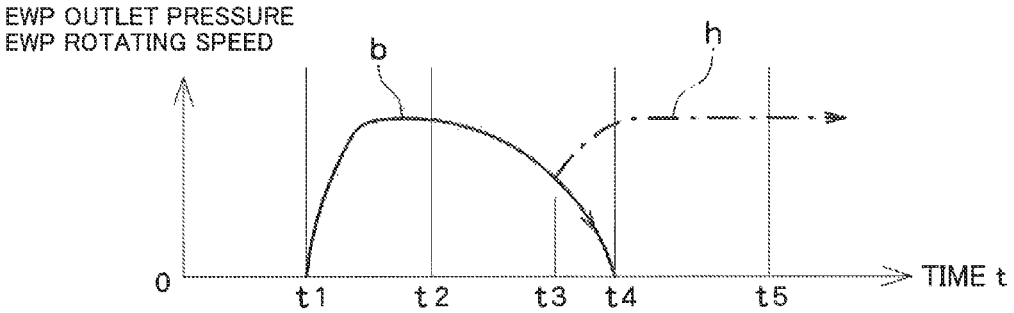
FIG. 8B is a graph illustrating the change of a discharging flow rate and a rotational speed of the electromagnetic valve over time when the engine is intermittently stopped in the engine cooling system according to the embodiment of the present invention.
Figure 8C:
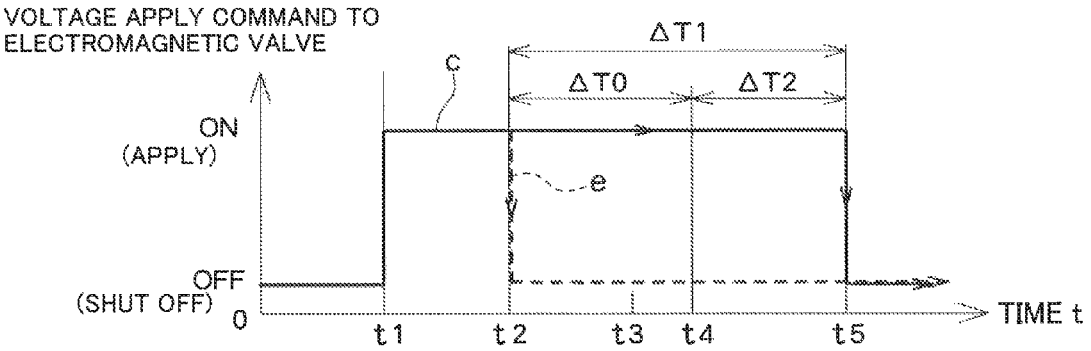
FIG. 8C is a graph illustrating the change of a voltage apply command of the electromagnetic valve over time when the engine is intermittently stopped in the engine cooling system according to the embodiment of the present invention.
Figure 8D:
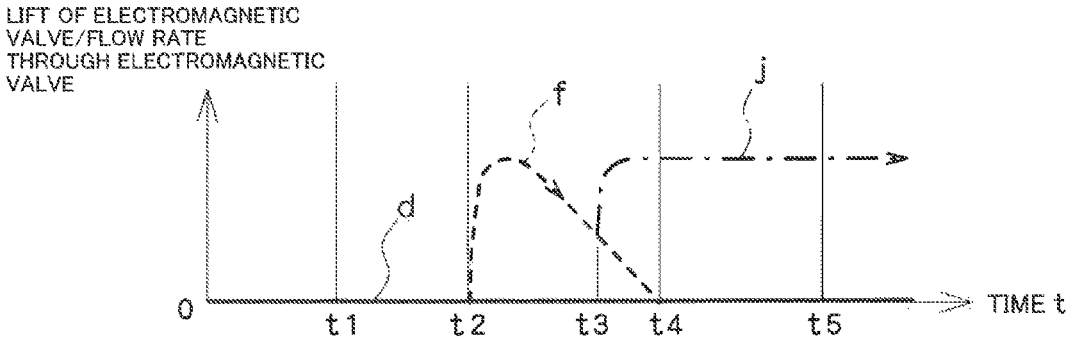
FIG. 8D is a graph illustrating the change of a lift of the electromagnetic valve or a flow rate passing through the electromagnetic valve over time when the engine is intermittently stopped in the engine cooling system according to the embodiment of the present invention.

After time t1 illustrated in FIGS. 8A to 8D, if the temperature of the refrigerant detected by the temperature sensor 41 at the outlet of the engine is lower than a predetermined temperature such as 60° C., the control unit 50 determines that the engine 10 is warming up and holds the voltage apply command in the on state to continue voltage application to the electromagnetic coil 15 of the electromagnetic valve 14 to keep the electromagnetic valve in the closed state. The control unit 50 also holds the EWP drive command in the on state to continue operation of the EWP 13. In this state, if the signal to intermittently stop the engine 10 is input from the ECU 55 to the control unit 50, as illustrated in step S103 of FIG. 7, the control unit 50 determines that the engine 10 has been intermittently stopped according to the temperature of the engine lower than the predetermined temperature mentioned above (e.g., 60° C.). Then the process proceeds to step 3104 as illustrated in FIG. 7. When the engine 10 is intermittently stopped, the ECU 55 supplies a command to stop the EWP 13 in accordance with the operation state of the engine 10 immediately before the engine 10 is intermittently stopped. When the control unit 50 determines that the command signal to stop the EWP 13 is input from the ECU 55 in step S104 of FIG. 7, the process proceeds to step S105 of FIG. 7 such that the drive command of the EWP 13 is switched from the on state to the off state at time t2, as illustrated in FIG. 8A, to stop the EWP 13. Meanwhile, as illustrated in FIG. 8C, the control unit 50 does not switch the voltage apply command of the electromagnetic valve 14 and keeps the command in the on state (applying the voltage), causing the electromagnetic valve 14 to be kept in the closed state.

When the EWP 13 is stopped at time t2 illustrated in FIG. 8A, the rotational speed of the EWP 13 is decreased and the discharging pressure is also gradually decreased after time t2, as indicated by the solid line b of FIG. 8B. As the rotational speed or the discharging pressure of the EWP 13 becomes zero at time t4, as illustrated in FIG. 8B, the pressure on the side of the refrigerant inlet 62 of the electromagnetic valve 14 becomes zero. As described above by reference to FIGS. 2 and 3, when the pressure of the electromagnetic valve 14 on the side of the refrigerant inlet 62 is zero, the valve body 66 is seated on the valve seat 65 by the pressing force of the coil spring 67, and the electromagnetic valve 14 is closed. That is, the closed valve state in which the valve body is seated on the valve seat 65 can be maintained even without the voltage application to the electromagnetic coil 15 of the electromagnetic valve 14.

The control unit 50 switches the drive command of the EWP 13 to the off state at time t2 illustrated in FIG. 8A, and then starts counting the first predetermined time period as illustrated in step S106 of FIG. 7. The first predetermined time period ΔT1 is obtained by adding a period ΔT0 to a period ΔT1, where ΔT0 is the period between time t2 and time t4 at which the rotational speed and the discharging pressure of the EWP become zero as illustrated in FIG. 8C, and ΔT1 is spare time. As illustrated in step S106 of FIG. 7, the control unit 50 waits until the first predetermined period ΔT1 has passed. When the first predetermined period ΔT1 has passed, the process proceeds to step S107 illustrated in FIG. 7 at time t5 illustrated in FIG. BC, and the voltage apply command of the electromagnetic valve 14 is switched from the on state (applying the voltage) to the off state (shutting off the voltage) at time t5 illustrated in FIG. 8C as indicated by a solid line c in FIG. 8C. Accordingly, the voltage application to the electromagnetic coil 15 of the electromagnetic valve 14 is shut off. As described above, since the discharging pressure is zero after time t4, the valve body 66 is pressed on the valve seat 65 by the pressing force of the coil spring 67 even when the voltage application to the electromagnetic coil 15 of the electromagnetic valve 14 is shut off, such that the closed valve state of the electromagnetic valve 14 is maintained. When the voltage application to the electromagnetic coil 15 is shut off at time t5 of FIG. 8C, the lift of the electromagnetic valve 14 is kept to zero as indicated by the solid line d of FIG. 8D, and the flow rate of the refrigerant passing through the electromagnetic valve 14 is also kept to zero. Since the valve body 66 is seated on the valve seat 65 when the EWP 13 is restarted in this state, the seated state of the valve body 66 seated on the valve seat 65 is maintained by the suction force caused by the electromagnetic coil 15 by applying the voltage to the electromagnetic coil 15. It is therefore possible to allow only a small quantity of refrigerant to flow through the very small hole 68 of the engine 10, as indicated by R0 of FIG. 4. As a result, the power consumption can be decreased while the engine is intermittently stopped, and the warm refrigerant can be held inside the engine while the engine 10 is intermittently stopped. Thus, the fuel efficiency is improved by decreasing the warming up time during the restart of the engine.

Meanwhile, as indicated by a broken line e of FIG. 8C, the control unit 50 switches the drive command of the EWP 13 to the off state at time t2 and switches the voltage apply command to the electromagnetic valve 14 to the off state to shut off the voltage application to the electromagnetic coil 15 of the electromagnetic valve 14. In this state, the EWP 13 still continues rotation due to the inertia force and the discharging pressure has not been decreased, causing the valve body 66 to be detached from the valve seat 65 (the lift is increased), as indicated by a broken line f in FIG. 8D. As a result, the refrigerant passes through the electromagnetic valve 14 and the warm refrigerant held in the engine 10 flows toward the outside of the engine 10. As indicated by the broken line f in FIG. 8D, such an outflow of the refrigerant to the outside becomes smaller as the rotational speed and the discharging pressure of the EWP 13 are decreased, and becomes zero at time t4 at which the rotational speed or the discharging pressure of the EWP 13 becomes zero.

However, as indicated by a dash-dot-line g in FIG. 8A, when the drive command of the EWP 13 is switched from the off state to the on state and the EWP 13 is restarted at time t3 preceding time t4 at which the rotational speed and the discharging pressure of the EWP 13 become zero, the rotational speed and the discharging pressure of the EWP 13 are increased as indicated by a dash-dot-line h in FIG. 8B. After time t3, the distance the valve body 66 is detached from the valve seat 65 is increased (the lift is increased), as indicated by a dash-dot-line j in FIG. 8D, to thereby increase the flow rate of the refrigerant passing through the electromagnetic valve 14. At this time, as described above by reference to FIG. 3, the valve body 66 has been moved to the upper side of the cavity 64, such that it is not possible to seat the valve body 66 on the valve seat 65 by the suction force of the electromagnetic coil 15 even when the voltage is applied to the electromagnetic coil 15 of the electromagnetic valve 14. This leads to the outflow of the warm refrigerant held inside the engine 10 and the increase of the warming up time of the engine 10.

As described above, when the engine 10 is intermittently shut off during warming up after the cold start of the engine 10, the engine cooling system 70 of the present embodiment can shut off the current application to the electromagnetic valve 14 while holding the closed state of the electromagnetic valve 14. It is possible, therefore, to decrease the power consumption during the intermittent stoppage of the engine 10 and hold the warm refrigerant inside the engine 10. As a result, the engine can be restarted with a shorter warming up time to improve the fuel efficiency.

In the embodiment having been described above, the control unit 50 shuts off the voltage application to the electromagnetic coil 15 of the electromagnetic valve 14 after the first predetermined time period ΔT1 has passed after the operation of the EWP 13 is stopped. Alternatively, for example, the rotational speed sensor 44 illustrated in FIG. 1 may detect the actual rotational speed of the EWP 13 to detect a time when the actual rotational speed of the EWP 13 is zero, such as at time t4 illustrated in FIG. 8B, and may shut off the voltage application to the electromagnetic coil 15 after the spare time ΔT2 illustrated in FIG. 8C has passed. It may also be possible that the pressure sensor 45 illustrated in FIG. 1 detects the discharging pressure of the EWP 13 to detect a time when discharging pressure of the EWP 13 is zero, such as at time t4 illustrated in FIG. BE, and shuts off the voltage application to the electromagnetic coil 15 after the spare time ΔT2 illustrated in FIG. 8C has passed. The spare time ΔT2 represents a second predetermined time period.

The period of time to be taken until the rotational speed and the discharging pressure of the EWP 13 become zero is increased in accordance with the increase of the actual rotational speed and the discharging pressure immediately before the EWP 13 is stopped. Thus, the first predetermined time period ΔT1 and the second predetermined time period ΔT2 may not be fixed, and the actual rotational speed on the discharging pressure of the EWP 13 may be monitored by the rotational speed sensor 44 or the pressure sensor 45. If the actual rotational speed or the discharging pressure of the EWP 13 is increased, the first predetermined time period ΔT1 or the second predetermined time period ΔT2 may be increased. If the actual rotational speed or the discharging pressure of the EWP 13 is decreased, the first predetermined period ΔT1 or the second predetermined period ΔT2 may be decreased. As a result, the time of applying voltage to the electromagnetic coil 15 can be decreased, and the power consumption can be further decreased while the engine 10 is intermittently stopped.

<System Structure of Another Engine Cooling System>

Figure 9:
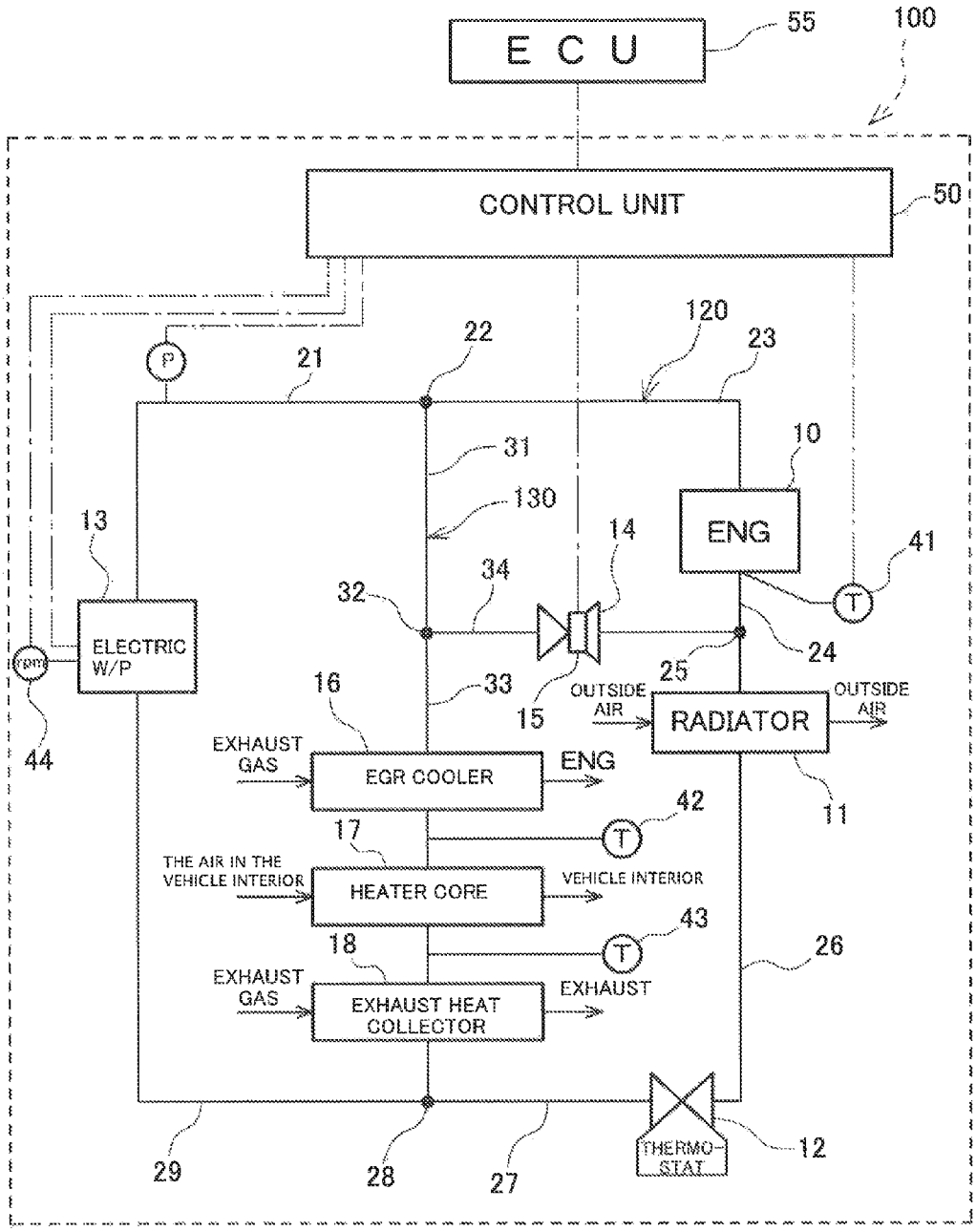
FIG. 9 is a system diagram illustrating the structure of an engine cooling system according to another embodiment of the present invention.

Next, another engine cooling system 100 according to another embodiment will be described with reference to FIGS. 9 to 12. The same reference signs are given to parts that are similar to those described above by reference to FIGS. 1 to 8D, and the description thereof will not be repeated. As illustrated in FIG. 9, the engine cooling system 100 includes a first refrigerant circulation flow channel 120 passing through the interior of the engine 10, a second refrigerant circulation flow channel 130 bypassing the engine 10, a connecting flow channel 34 that connects the outlet of the engine 10 of the first refrigerant circulation flow channel 120 with the second refrigerant circulation flow channel 130, the EWP 13 that circulates a refrigerant through the first refrigerant circulation flow channel 120, the second refrigerant circulation flow channel 130, and the connecting flow channel 34, the electromagnetic valve 14 arranged in the connecting flow channel 34 and changes a flow rate of the refrigerant passing through an engine 10, an exhaust gas recirculation (EGR) cooler 16 that is a heat exchanger arranged in the second refrigerant circulation flow channel 130, the heater core 17, the exhaust heat collector 18, and the control unit 50. The radiator 11 and the thermostat 12 are arranged between the outlet of the engine 10 and the EWP 13 in the first refrigerant circulation flow channel 120.

As illustrated in FIG. 9, the first refrigerant circulation flow channel 120 includes the pump outlet tube 21 that spans between the EWP 13 and a branch point 22 of the second refrigerant circulation flow channel 130, the engine inlet tube 23 that spans between the branch point 22 and the inlet of the engine 10, the engine outlet tube 24 that connects the outlet of the engine 10 with the radiator 11, the radiator outlet tube 26 that connects the radiator 11 with the thermostat 12, the thermostat outlet tube 27 that connects the thermostat 12 with the junction point 28 of the second refrigerant circulation flow channel 130, and the pump inlet tube 29 between the junction point 28 and the electric refrigerant pump 13. Specifically, the first refrigerant circulation flow channel 120 is the flow channel in which the refrigerant circulates through [the EWP 13, the pump outlet tube 21, the branch point 22, the engine inlet tube 23, the engine 10, the engine outlet tube 24, the radiator 11, the radiator outlet tube 26, the thermostat 12, the thermostat outlet tube 27, the junction point 28, the pump inlet tube 29, and the EWP 13].

The second refrigerant circulation flow channel 130 includes an engine bypass tube 31 branching from the branch point 22 of the first refrigerant circulation flow channel 120 to bypass the engine 10 to reach a junction point 32 with the connecting flow channel 34, and a radiator bypass tube 33 running from the junction point 32 to bypass the radiator 11 to reach the junction point 28 of the first refrigerant circulation flow channel 120. The EWP 13, the pump outlet tube 21, and the pump inlet tube 29 are common to the first refrigerant circulation flow channel 120. The radiator bypass tube 33 includes the EGR cooler 16 that cools exhaust gas recirculating in the engine 10 from the upstream side, the heater core 17 used for heating the air in the interior of the vehicle, and an exhaust heat collector 18 that collects heat of the exhaust gas of the engine 10 into the refrigerant. Thus, the second refrigerant circulation flow channel 130 circulates the refrigerant through [the EWP 13, the pump outlet tube 21, the branch point 22, the engine bypass tube 31, the junction point 32, the radiator bypass tube 33, the EGR cooler 16, the heater core 17, the exhaust heat collector 18, the junction point 28, the pump inlet tube 29, the and the EWP 13].

The connecting flow channel 34 is the refrigerant flow channel that connects the branch point 25 of the engine outlet tube 24 of the first refrigerant circulation flow channel 120 with the junction point 32 of the second refrigerant circulation flow channel 130, with the electromagnetic valve 14 driven to be opened/closed by the electromagnetic coil 15 being disposed in the middle of the connecting flow channel 34. The electromagnetic valve 14 is the valve used to open/close the refrigerant flow (i.e., change the flow rate of the refrigerant) from the first refrigerant circulation flow channel 120 to the second refrigerant circulation flow channel 130. In the present embodiment, temperature sensors 42, 43 that detect the temperature of the refrigerant are disposed at the inlets of the heater core 17 and the exhaust heat collector 18, respectively.

The electromagnetic valve 14 attached to the engine cooling system 100 of the present embodiment is similar to the electromagnetic valve 14 described above by reference to FIGS. 2 and 3, and the description thereof will not be repeated.

<Operation of the Engine Cooling System 100 and the Flow of Refrigerant During Cold Start of the Engine>

An operation and a refrigerant flow during the cold start of the engine in the engine cooling system 100 having the system structure described above and the electromagnetic valve 14 will be briefly described below. In the initial state, both the EWP 13 and the engine 10 are stopped, while the electromagnetic valve 14 is closed and the flow of the refrigerant is also stopped. The thermostat 12 is in the closed state as well, because of the low temperature of the engine 10.

Figure 10:
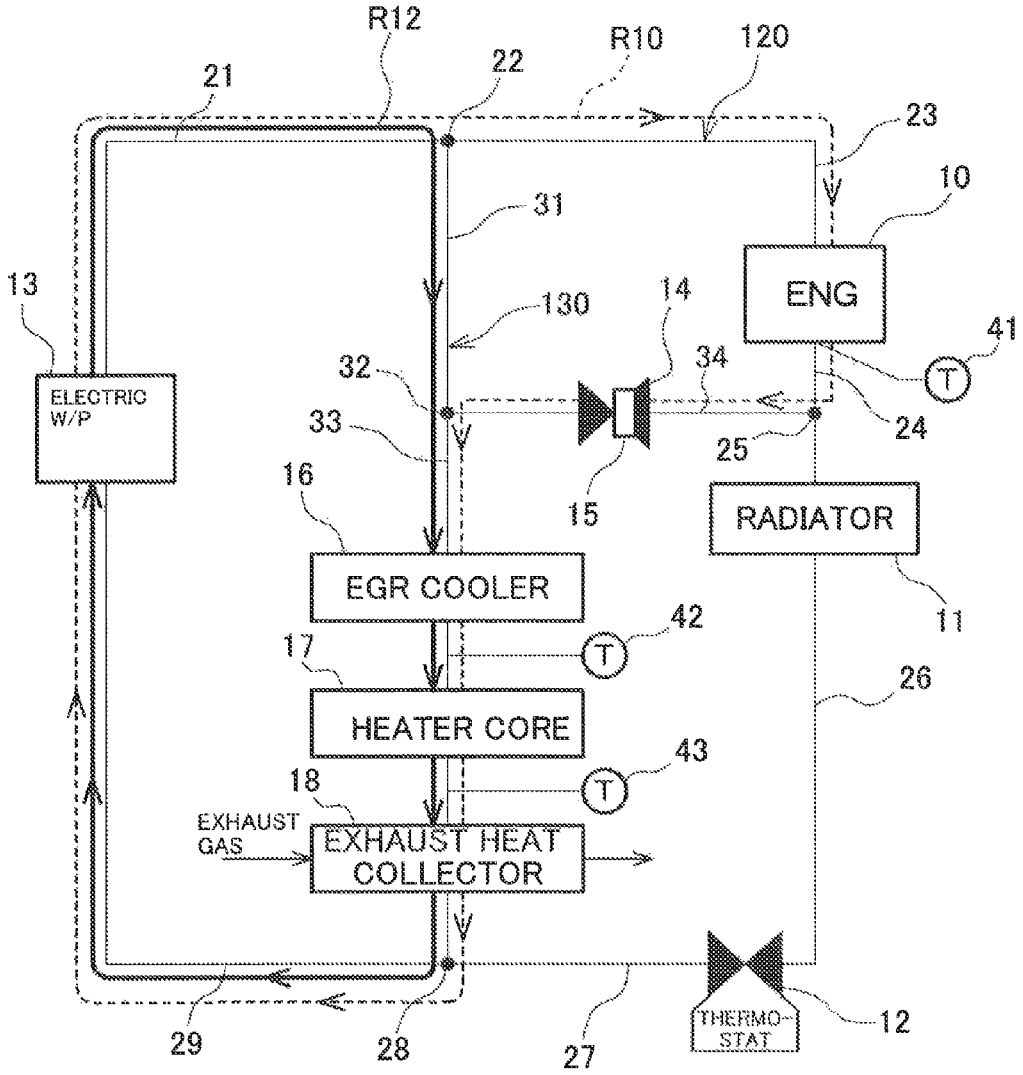
FIG. 10 is an explanatory view illustrating a refrigerant flow immediately after the cold start of the engine in the engine cooling system according to another embodiment of the present invention.

When a signal representing the start of the engine 10 is input to the control unit 50 from the ECU, the control unit 50 applies voltage to the electromagnetic coil 15 of the electromagnetic valve 14 to start the EWP 13. Since the voltage has already been applied to the electromagnetic coil 15 of the electromagnetic valve 14, the valve body 66 is sucked to the valve seat 65 and kept in the seated state even when the pressure of the refrigerant is applied on the valve body 66 in accordance with the start of the EWP 13. In this state, the electromagnetic valve 14 is in the closed state, as illustrated in FIG. 10, such that the refrigerant discharged from the EWP 13 circulates in the second refrigerant circulation flow channel 130 through the EWP 13, the pump outlet tube 21, the branch point 22, the engine bypass tube 31, the radiator bypass tube 33, the EGR cooler 16, the heater core 17, the exhaust heat collector 18, the junction point 28, the pump inlet tube 29, and the EWP 13 (the circulation flow channel of the refrigerant is indicated by R12 in FIG. 10). Meanwhile, as indicated by a broken line arrow R10 in FIG. 10, a very small quantity of refrigerant flows through the very small hole 68 of the valve body 66 of the electromagnetic valve 14 from the first refrigerant circulation flow channel 120 to the second refrigerant circulation flow channel 130 through the connecting flow channel 34 through the EWP 13, the pump outlet tube 21, the branch point 22, the engine inlet tube 23, the engine 10, the engine outlet tube, the connecting flow channel 34, the electromagnetic valve 14, the junction point 32, the radiator bypass tube 33, the EGR cooler 16, the heater core 17, the exhaust heat collector 18, the junction point 28, the pump inlet tube 29, and the EWP 13. The flow rate is sufficient to equalize the temperature of the refrigerant inside the engine 10. Accordingly, the temperature of the refrigerant accommodated in the interior (e.g., the water jacket) of the engine 10 is gradually raised by the heat generated by combustion of the engine 10. Meanwhile, the exhaust gas of the engine 10 flows to the exhaust heat collector 18 where the temperature of the refrigerant is raised by the heat of the exhaust gas. Thus, when the temperature of the engine 10 is low and the load is small immediately after the start of the engine 10, the temperature of the engine 10 itself is increased by the combustion within the engine 10. The temperature of the refrigerant circulating in the second refrigerant circulation flow channel 130 is heated by the exhaust heat of the engine 10.

Figure 11:
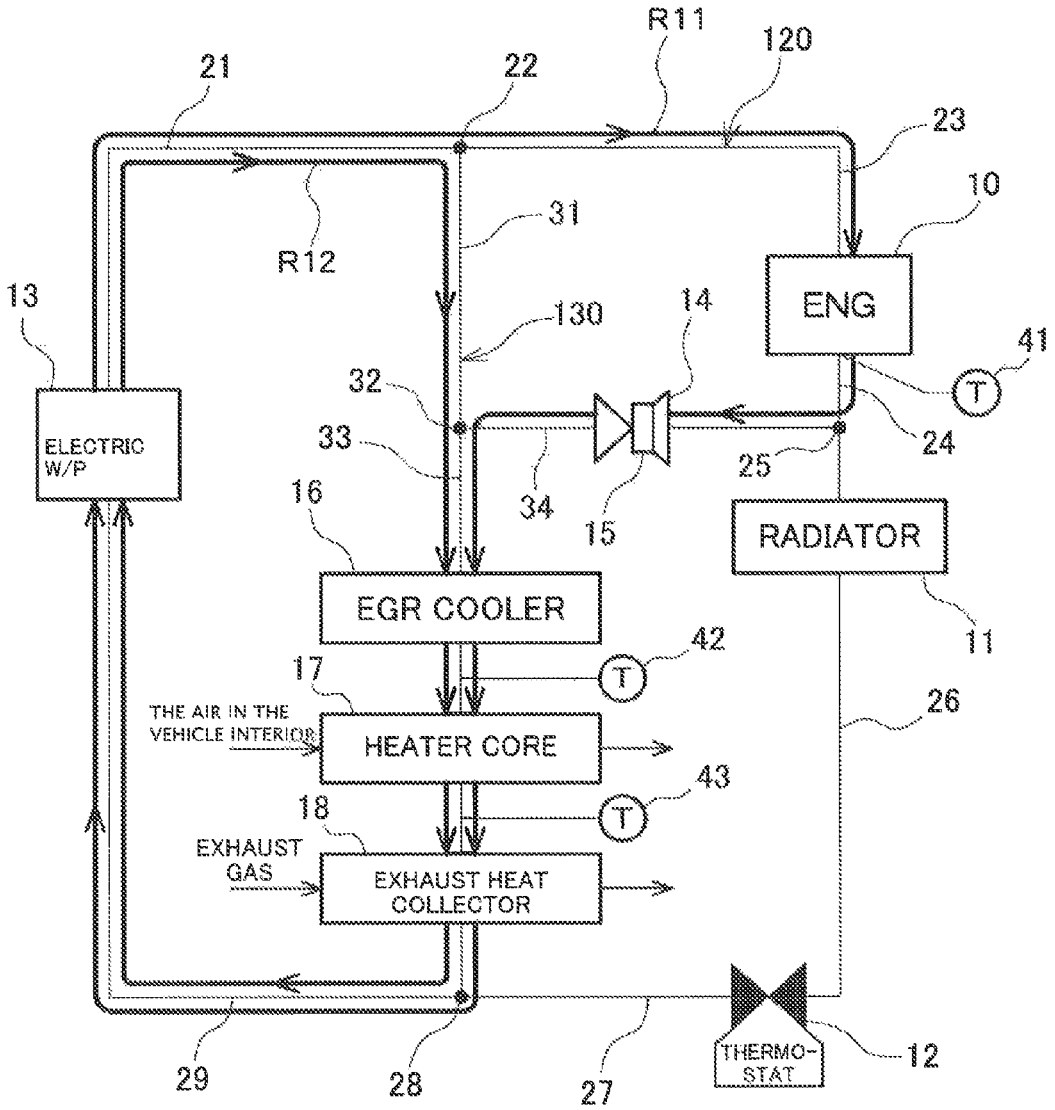
FIG. 11 is an explanatory view illustrating a refrigerant flow during warming up of the engine in the engine cooling system according to another embodiment of the present invention.
Figure 12:
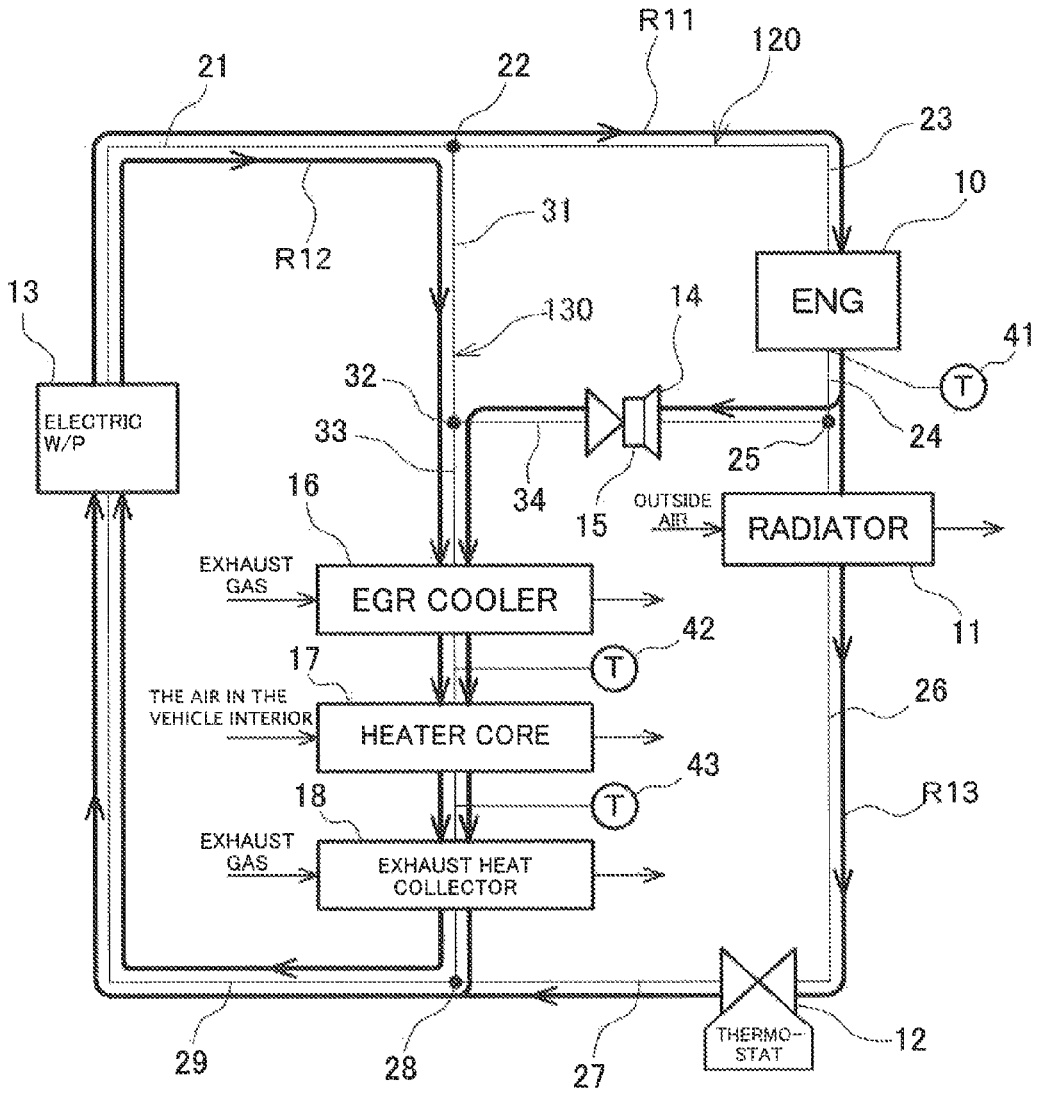
FIG. 12 is an explanatory view illustrating a refrigerant flow after the engine is warmed up (during normal operation) in the engine cooling system according to another embodiment of the present invention.

When the temperature of the refrigerant is detected by the temperature sensor 41 at the engine outlet and the temperature has been raised to a predetermined temperature such as about 60° C., the control unit 50 shuts off the voltage application to the electromagnetic coil 15 in order to allow more refrigerant to flow to the engine 10. Since the EWP 13 is in operation, the valve body 66 is detached from the valve seat 65 by the pressure of the refrigerant when the voltage application to the electromagnetic coil 15 is shut off, and moves to the upper side of the cavity 64 to open the valve. Upon opening of the electromagnetic valve 14, the flow rate of the refrigerant flowing through the circulation channel indicated by R10 described above is increased. In FIG. 11, the refrigerant flow with an increased flow rate is indicated by a solid line arrow R11. At this point, the refrigerant does not flow through the radiator 11 or the thermostat 12, because the temperature of the engine 10 is lower than the temperature at which the thermostat 12 is opened.

In this state, the temperature of the refrigerant flowing through the first refrigerant circulation flow channel 120 and the second refrigerant circulation flow channel 130 has been raised to about 50 to 60° C. If heating of the interior of the vehicle is requested, the air in the interior of the vehicle flows in the heater core 17 and the heated air is blown to the interior of the vehicle from a blower. As the engine 10 is run for a while in this state, the temperature of the engine 10 is gradually increased and the temperature of the refrigerant is also increased. When the temperature of the refrigerant at the outlet of the engine 10 is raised to a temperature such as about 80° C., the thermostat 12 is opened and the refrigerant starts to flow from the outlet of the engine through the radiator 11 and the junction point 28 to the EWP 13. The flow of the refrigerant is indicated by R13 in FIG. 12. As such, the refrigerant flows through the flow channels indicated by R11, R12, and R13, respectively, to enter the normal operation. When the load of the engine 10 is increased, the EGR is turned on. In this case, the exhaust gas of the engine 10 also flows into the EGR cooler and the heat of the exhaust gas is collected into the refrigerant, as in the exhaust heat collector 18, to raise the temperature of the refrigerant. After passing through the exhaust heat collector 18, the refrigerant with an increased temperature is cooled by the radiator 11.

<Operation of the Engine Cooling System when the Engine is Stopped Intermittently During the Warming Up Operation after Cold Start of the Engine>

An operation of the engine cooling system 100 when the engine is stopped intermittently during the warming up operation after the cold start of the engine 10 is substantially the same as the operation of the engine cooling system 70 described above, and the description thereof will be given only briefly.

When the engine 10 is started in the cold state, the control unit 50 starts operating the EWP 13 at time t1 indicated in FIGS. 8A to 80 at which the engine 10 is cold started. As indicated by the solid line b of FIG. 8B, the rotational speed and the discharging pressure of the EWP 13 are increased from time t1. The control unit 50 applies a voltage to the electromagnetic coil 15 of the electromagnetic valve 14 at time t1. Thus, the electromagnetic valve 14 is kept in the closed state even when the EWP 13 starts operation. As indicated by the solid line d of FIG. 8D, the flow rate of the refrigerant passing through the electromagnetic valve 14 is kept substantially zero. As described by reference to FIG. 10, since the thermostat 12 is also closed immediately after the cold start of the engine 10, the refrigerant circulates through the second refrigerant circulation flow channel 130 indicated by R12 of FIG. 10. Also, a very small quantity of refrigerant flows through the interior of the engine 10, as indicated by a broken line arrow R10 in FIG. 10. Similar to the operation immediately after the cold start of the engine 10 having been described by reference to FIG. 4, the temperature of the engine 10 is raised by the heat generated by fuel combustion in the engine 10. Accordingly, the refrigerant is heated by the heat of the exhaust gas passing through the exhaust heat collector 18 to increase the temperature of the refrigerant.

When the signal to intermittently stop the engine 10 is input from the ECU 55 to the control unit 50, the control unit 50 switches the drive command of the EWP 13 from the off state to the on state at time t2 illustrated in FIG. 8A to stop the EWP 13. Meanwhile, as illustrated in FIG. 8C, the control unit 50 keeps the on state (applying the voltage) of the voltage apply command of the electromagnetic valve 14 at time t2, such that the electromagnetic valve 14 is kept in the closed state. When the predetermined time Δt1 has passed after the drive command of the EWP 13 is switched to the off state, the control unit 50 switches the voltage apply command of the electromagnetic valve 14 to the off state (shutting off the voltage) from the on state (applying the voltage) at time t5 illustrated in FIG. 8C.

As described above, since the discharging pressure of the EWP 13 is zero after time t4, the valve body 66 is pressed on the valve seat 65 by the pressing force of the coil spring 67 to keep the closed state if the voltage application to the electromagnetic coil 15 of the electromagnetic valve 14 is shut off. Accordingly, when the voltage application to the electromagnetic coil 15 is shut off at time t5 of FIG. 8C, the lift of the electromagnetic valve 14 is kept to zero as indicated by the solid line d in FIG. 8D, and the flow rate of the refrigerant passing through the electromagnetic valve 14 can also be kept to zero. Further, when the EWP 13 is restarted from this state, the valve body 66 is seated on the valve seat 65 and can be kept in the seated stated on the valve seat 65 by the suction force of the electromagnetic coil 15 by applying the voltage to the electromagnetic coil 15. Similar to the engine cooling system 70 having been described above, the engine cooling system 100 of the present embodiment, therefore, can also decrease the power consumption while the engine is intermittently stopped. At the same time, the refrigerant can be held in the warm state in the interior of the engine 10 while the engine is intermittently stopped. As a result, the warming up time of the engine during restarting of the engine is shortened to improve the fuel efficiency.

As described above, the electromagnetic valve 14 of the engine cooling system 100 is similar to the electromagnetic valve 14 described by reference to FIGS. 2 and 3. Alternatively, the electromagnetic valve 14 with no very small hole 68 formed therein may be used in the present embodiment. In this case, the refrigerant does not flow through the flow channel indicated by a broken line arrow R10 or in the interior of the engine 10, as illustrated in FIG. 10, while the electromagnetic valve 14 is closed. Other operations, however, may be similar to the embodiment having been described above by reference to FIGS. 9 to 12 and a similar effect can be provided.

What is claimed is:

1. An engine cooling system, comprising:

a refrigerant circulation flow channel passing through the interior of an engine;

a refrigerant pump configured to circulate a refrigerant through the refrigerant circulation flow channel;

an electromagnetic valve arranged in the refrigerant circulation flow channel and changing a flow rate of the refrigerant passing through the engine; and a control unit configured to start/stop the refrigerant pump and open/close the electromagnetic valve, wherein when the electromagnetic valve is in a closed state and the refrigerant pump is in operation, the control unit stops operation of the refrigerant pump, waits a first predetermined time period after stopping the refrigerant pump, and shuts off voltage application to the electromagnetic valve after waiting the first predetermined time period.

2. The engine cooling system according to claim 1, further comprising:

a rotational speed sensor configured to detect a rotational speed of the refrigerant pump, wherein the control unit shuts off the voltage application when a second predetermined time period has passed after the rotational speed sensor detects that an actual rotational speed of the refrigerant pump is zero.

3. The engine cooling system according to claim 2, further comprising:

a pressure sensor configured to detect a discharging pressure of the refrigerant pump, wherein the control unit increases the first predetermined time period in accordance with an increase of the discharging pressure of the refrigerant pump detected by the pressure sensor immediately before the refrigerant pump is stopped or the actual rotational speed detected by the pressure sensor immediately before the refrigerant pump is stopped.

4. The engine cooling system according to claim 1, further comprising:

a rotational speed sensor configured to detect a rotational speed of the refrigerant pump; and a pressure sensor configured to detect a discharging pressure of the refrigerant pump, wherein the control unit increases the first predetermined time period in accordance with an increase of the discharging pressure of the refrigerant pump detected by the pressure sensor immediately before the refrigerant pump is stopped or the actual rotational speed detected by the pressure sensor immediately before the refrigerant pump is stopped.

5. The engine cooling system according to claim 1, wherein the electromagnetic valve includes a casing in which a valve seat on which a valve body is seated is formed, an electromagnetic coil mounted on the side of a refrigerant inlet of the valve seat in the casing, and a spring pressing the valve body toward the valve seat, pressing force of the spring is smaller than force exerted on the valve body by driving the refrigerant pump in a direction from the side of the refrigerant inlet to the side of the refrigerant outlet, when the voltage application to the electromagnetic coil is shut off while the refrigerant pump is stopped, the valve body is pressed on the valve seat and kept in a closed state by the pressing force of the spring, and when the voltage application to the electromagnetic coil is shut off while the refrigerant pump is in operation, the valve body is opened so as to be detached from the valve seat by a pressure of the refrigerant from the side of the refrigerant inlet.

6. The engine cooling system according to claim 1, wherein the refrigerant circulation flow channel includes a first refrigerant circulation flow channel passing through the interior of the engine, a second refrigerant circulation flow channel bypassing the engine, and a connecting flow channel connecting an engine outlet of the first refrigerant circulation flow channel with the second refrigerant circulation flow channel, the refrigerant pump is configured to circulate the refrigerant through the first refrigerant circulation flow channel, the second refrigerant circulation flow channel, and the connecting flow channel, and the electromagnetic valve is arranged in the connecting flow channel, and changes a flow rate of the refrigerant flowing from the first refrigerant circulation flow channel, through the engine, and to the second refrigerant circulation flow channel.

7. A method of operating an engine cooling system, the engine cooling system including a refrigerant circulation flow channel passing through the interior of an engine, a refrigerant pump configured to circulate a refrigerant through the refrigerant circulation flow channel, and an electromagnetic valve arranged in the refrigerant circulation flow channel and changing a flow rate of the refrigerant passing through the engine, the method of operating the engine cooling system comprising:

when the electromagnetic valve is in a closed state and the refrigerant pump is in operation, stopping operation of the refrigerant pump, waiting a first predetermined time period after stopping the refrigerant pump, and shutting off voltage application to the electromagnetic valve after waiting the first predetermined time period.

* * * * *